United States Patent [19]

Grace

[11] 4,318,610

[45] Mar. 9, 1982

[54] CONTROL SYSTEM FOR AN ELECTROPHOTOGRAPHIC PRINTING MACHINE

[75] Inventor: Robert E. Grace, Fairport, N.Y.

[73] Assignee: Xerox Corporation, Stamford, Conn.

[21] Appl. No.: 142,490

[22] Filed: Apr. 21, 1980

[51] Int. Cl.[3] ..... G03G 15/00

[52] U.S. Cl. ..... 355/14 D; 355/14 CH

[58] Field of Search ..... 355/3 R, 14 R, 14 CH, 355/14 D

[56] References Cited

U.S. PATENT DOCUMENTS

| | | | |
|---|---|---|---|
| 2,956,487 | 10/1960 | Giaimo | 355/14 D |
| 3,348,522 | 10/1967 | Donohue | 118/7 |
| 3,348,523 | 10/1967 | Davidson et al. | 118/7 |
| 3,553,464 | 1/1971 | Abe | 356/201 |
| 3,754,821 | 8/1973 | Whited | 355/4 |
| 3,788,739 | 1/1974 | Coriale | 355/3 R X |
| 4,215,930 | 8/1980 | Miyakawa et al. | 355/14 D |

FOREIGN PATENT DOCUMENTS

| | | | |
|---|---|---|---|
| 1559341 | 1/1980 | United Kingdom | 355/14 CH |

*Primary Examiner*—Fred L. Braun

*Attorney, Agent, or Firm*—H. Fleischer; H. M. Brownrout

[57] ABSTRACT

An apparatus in which toner particle concentration within a developer mixture and charging of the photoconductive surface are controlled. A first test area and a second test area are recorded on the photoconductive surface. Toner particles are deposited on the first test area having a greater density than the toner particles deposited on the second test area. Concentration of toner particles within the developer mixture is controlled in response to the toner particle density of the first test area. Charging of the photoconductive surface is regulated in response to the toner particle density of the second test area.

4 Claims, 2 Drawing Figures

CONTROL SYSTEM FOR AN ELECTROPHOTOGRAPHIC PRINTING MACHINE

Figure 1:
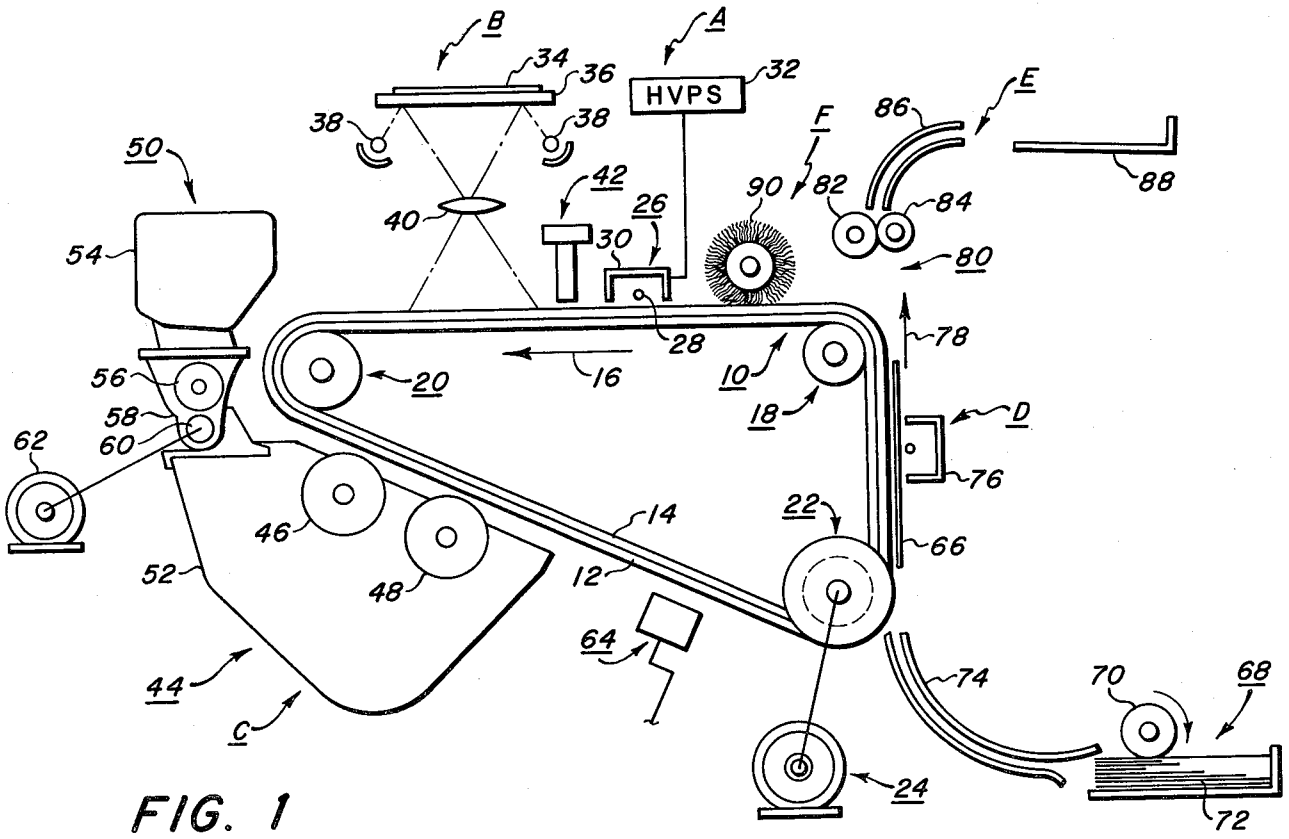

This invention relates generally to an electrophotographic printing machine, and more particularly concerns an apparatus for controlling the concentration of toner particles in a developer mixture and the charging of a photoconductive member.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is heated to permanently affix it to the copy sheet in image configuration.

A common type of developer mixture frequently used in electrophotographic printing machines comprises carrier granules having toner particles adhering triboelectrically thereto. This two component mixture is brought into contact with the photoconductive surface. The toner particles are attracted from the carrier granules to the latent image. It is evident that the toner particles are depleted from the developer mixture and must be periodically replenished therein. The concentration of toner particles in the developer mixture is significant in order to maintain optimum development of the latent image. For example, if the toner particle concentration within the developer material is too low, the resultant copy will be too light. Contrariwise, if the toner particle concentration within the developer material is too high, the resultant copy will be too dark.

Another variable which seriously affects copy quality is the dark potential of the photoconductive surface.

In an electrophotographic printing machine, the overall control objective is to maintain the output density of the copy substantially constant relative to the input density of the original document. If variations in the steps of transfer and fusing are neglected, this is equivalent to maintaining the relationship between exposure at the photoconductive surface and the developed toner mass per unit area substantially constant. The relationship between exposure of the photoconductive surface and the developed mass area can be described in two steps a photo induced discharge curve relating image voltage to exposure as a function of dark development potential, residual voltage, thickness, and composition of the photoconductive surface; and a development curve relating the developed mass area to image voltage as a function of developer roller bias, toner particle concentration in the developer mixture, toner particle triboelectrical characteristics, developer conductivity, and the development geometry. In addition, the dark development potential of the photoconductive surface can be described as a function of the thickness of the photoconductive surface, environment, and charging current. Triboelectric characteristics and developed conductivity may be described as a function of toner particle concentration, developer material age, and environment. Generally, the disturbances affecting the relationship between exposure and developed mass/area are cyclic variations in dark development potential and residual voltage of the photoconductive surface, changes in environment, decreases in photoconductive surface thickness due to abrasion, changes in toner particle concentration due to variable toner particle consumption, and developer material aging. Control parameters available for adjustment during machine operation are charging current, developer roller bias potential, and toner particle concentration.

Hereinbefore, electrophotographic printing machines have included control loops for regulating the charging of the photoconductive surface and the concentration of toner particles within the developer mixture. The charge control loop employed an electrometer positioned adjacent the photoreceptor. The electrometer provided a signal proportional to the dark development potential of the photoconductive surface. This signal is conveyed to a controller which regulates a high voltage power supply energizing a corona generating device charging the photoconductive surface. Regulation of the power supply controls the charge on the photoconductive surface. In the control loop regulating the concentration of toner particles in the developer mixture, an infrared densitometer is disposed adjacent the photoconductive surface. The infrared densitometer generates a signal proportional to the mass of toner particles developed on a test patch recorded on the photoconductive surface. This signal is conveyed to a controller which actuates a toner particle dispenser to adjust the concentration of toner particles within the developer mixture.

Various types of control schemes for regulating the parameters of an electrophotographic printing machine have been devised. The following disclosures appear to be relevant:

U.S. Pat.No. 2,956,487
Patentee: Giaimo, Jr.
Issued: Oct. 18, 1960
U.S. Pat. No. 3,348,522
Patentee: Donohue
Issued: Oct. 24, 1967
U.S. Pat. No. 3,348,523
Patentee: Davidson et al.
Issued: Oct. 24, 1967
U.S. Pat. No. 3,553,464
Patentee: Abe
Issued: Jan. 5, 1971
U.S. Pat. No. 3,754,821
Patentee: Whited
Issued: Aug. 28, 1973

The relevant portions of the foregoing disclosures may be briefly summarized as follows:

Giaimo discloses a photocell which detects light rays reflected from a developed image. The signal from the photocell is then suitably processed to form a control signal. This control signal may be utilized to regulate a voltage source energizing a corona generator and the dispensing of toner particles into a developer mixture.

Donohue and Davidson et al. describe a device which exposes a stripe along the edge of the charged photoconductive drum. The stripe is developed with toner particles. A fiber bundle directs light rays onto the developed stripe and the bare surface of the photoconductive drum. One photocell detects the light rays reflected from the developed stripe. Another photocell detects the light rays reflected from the bare photoconductive surface. The photocells form two legs of a bridge circuit used to control toner dispensing.

Abe discloses a charged tape which is developed with toner particles. The tape passes between a light source and a photoelectric converter. The intensity of light detected by the photoelectric converter, as indicated by a meter, corresponds to the density of toner particles developed on the tape. If the tape is impervious to light, light rays may be reflected from the tape rather than being transmitted therethrough.

Whited discloses an electrically biased transparent plate secured to a photoconductive drum which is developed with toner particles. A light source directs light rays through the plate onto a photocell. The electrical output signal from the photocell is processed and an error signal generated for energizing a toner dispenser which furnishes additional toner particles to a developer mixture.

In accordance with the features of the present invention, there is provided an apparatus for controlling the concentration of toner particles and regulating the charging of a photoconductive surface. The apparatus includes means for forming a first test area and a second test area on the photoconductive surface. Toner particles are deposited on these test areas. The density of the toner particles deposited on the first test area is greater than the density of toner particles deposited on the second test area. Means, responsive to the density of the toner particles deposited on the first test area, control the concentration of toner particles in the developer mixture. The control means is responsive to the density of toner particles deposited on the second test area to regulate charging of the photoconductive surface.

Figure 2:
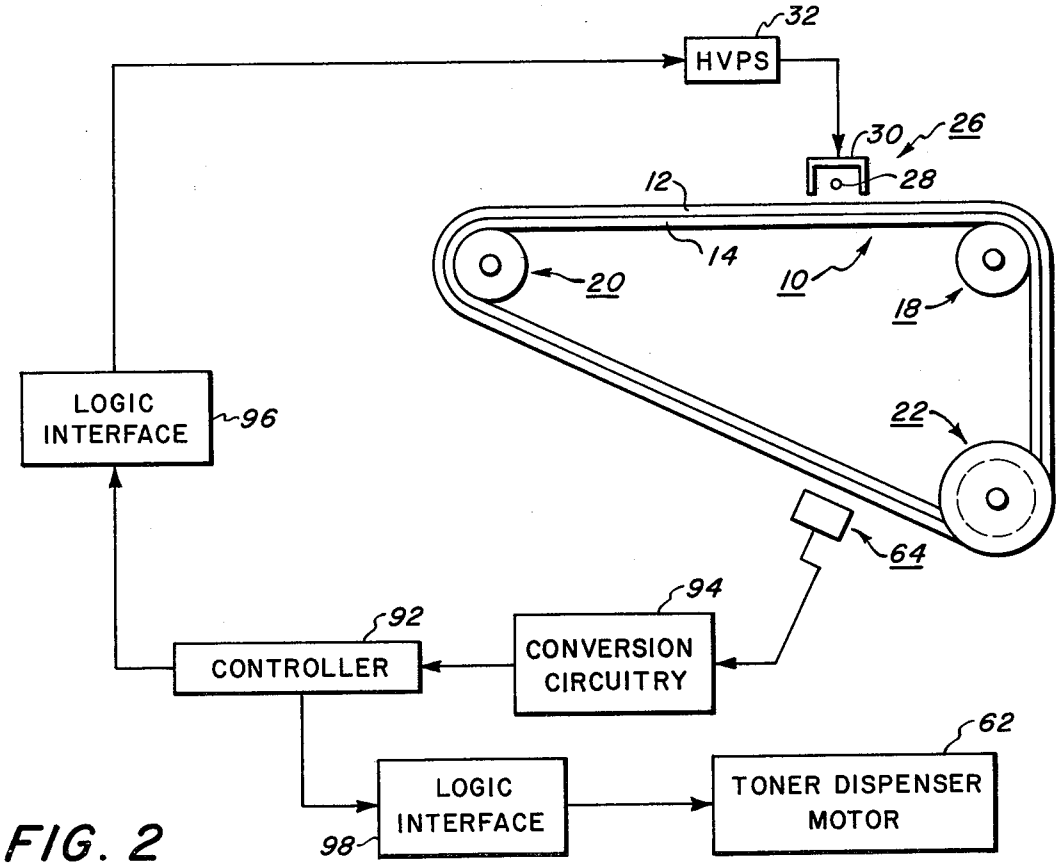

Other aspects of the present invention will become apparent as the following description proceeds and upon reference to the drawings, in which:

FIG. 1 is a schematic elevational view of an electrophotographic printing machine incorporating the features of the present invention therein; and FIG. 2 is a block diagram depicting the control loops employed in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the control system of the present invention therein. It will become apparent from the following discussion that this control system is equally well suited for use in a wide variety of electrophotographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

The control scheme of the present invention requires that two different developed mass areas be formed on the photoconductive surface. The toner particle density of each of these test areas is measured and resultant signals generated therefrom. In addition, a signal is generated corresponding to the bare photoconductive surface. By applying a set of control rules to ratio of the density signals to bare surface signal, it is possible to control the concentration of toner particles in the developer mixture and charging of the photoconductive surface. The utilization of ratio, rather than the absolute density signals, while not mandatory, minimizes the effect of slow drift in the density measurements.

Turning now to FIG. 1, the electrophotographic printing machine employs a belt 10 having a photoconductive surface 12 deposited on a conductive substrate 14. Preferably, photoconductive surface 12 comprises a transport layer containing small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device indicated generally by the reference numeral 26, charges photoconductive surface 12 to a relatively high, substantially uniform potential. Corona generating device 26 has a charging electrode 28 and a conductive shield 30 positioned adjacent photoconductive surface 12. Preferably, electrode 28 is a dielectrically coated wire comprising a tungsten core coated with aluminosilicate tungsten sealed glass. Shield 30 is made preferably from aluminum. High voltage power supply 32 is coupled to shield 30. A change in output of power supply 32 causes corona generating device 26 to vary the charge voltage applied to photoconductive surface 12. The control system of the present invention regulates the voltage level of power supply 32. The detailed structure of the charge control loop will be described hereinafter with reference to FIG. 2.

Next, the charged portion of photoconductive surface 12 is advanced through exposure station B. At exposure station B, an original document 34 is positioned face-down upon a transparent platen 36. Lamps 38 flash light rays onto original document 34. The light rays reflected from original document 34 are transmitted through lens 40 forming a light image thereof. Lens 40 focuses the light image onto the charged portion of photoconductive surface 12 to selectively dissipate the charge thereon. This records an electrostatic latent image on photoconductive surface 12 which corresponds to the informational areas contained within original document 34.

Exposure station B includes test area generator 42. Test area generator 42 comprises a light source electronically programmed to two different output levels. In this way, two different intensity test light images are projected onto the charged portion of photoconductive surface 12 in the inter-image area to record two test areas thereon. The light output level from test area generator 42 is such that one of the test light images receives an exposure of about 2.5 ergs/centimeter$^2$ with the other test light image receiving an exposure of about 1.7 ergs/centimeter$^2$. These test light images are projected onto the charged portion of photoconductive surface 12 to form the test areas. Both of these two test areas will be subsequently developed with toner particles. Test area generator 42 is continuously programmable from 0.0 to 6.0 ergs/centimeter$^2$. The exposure accuracy is $\pm 3\%$ over a range of from about 0.5 to about 3.5 ergs/centimeter$^2$. Each test area recorded on photoconductive surface 12 is rectangular and about 10 millimeters by 18 millimeters in size. Thus, the test area generator will expose the inter-image area to a level between 0.5 to 3.5 ergs/centimeter$^2$. Preferably, one test area will be exposed at a light intensity of about 2.5 ergs/centimeter$^2$ with the other test area being exposed at an intensity of about 1.7 ergs/centimeter$^2$. After the electrostatic latent image has been recorded on photoconductive surface 12 and the test areas recorded in the inter-image areas, belt 10 advances the electrostatic latent image and the test areas to development station C.

At development station C, a magnetic brush development system, indicated generally by the reference numeral 44, advances a developer material into contact with the electrostatic latent image and the test areas. Preferably, magnetic brush development system 44 includes two magnetic brush developer rollers 46 and 48. These rollers each advance the developer material into contact with the latent image and test areas. Each developer roller forms a brush comprising carrier granules and toner particles. The latent image and test areas attract the toner particles from the carrier granules forming a toner powder image on the latent image and a pair of developed mass areas corresponding to each of the test areas. As successive electrostatic latent images are developed, toner particles are depleted from the developer material. A toner particle dispenser, indicated generally by the reference numeral 50, is arranged to furnish additional toner particles to housing 52 for subsequent use by developer rollers 46 and 48 respectively. Toner dispenser 50 includes a container 54 storing a supply of toner particles therein. A foam roller 56 disposed in a sump 58 coupled to container 54 dispenses toner particles into an auger 60. Auger 60 comprises a helical spring mounted in a tube having a plurality of apertures therein. Motor 62 rotates the helical member of auger to advance the toner particles through the tube 30 that toner particles are disposed from the apertures thereof. Energization of motor 62 is controlled by the toner dispense control loop of the present invention. The detailed structure of the toner dispenser loop will be described hereinafter with reference to FIG. 2. Nominally, the test area which has been exposed at 2.5 erg/centimeter$^2$ will have a toner particle developed mass/area of approximately 0.1 milligrams/centimeters$^2$. The test area which has been exposed at 1.7 ergs/centimeter$^2$ will have a toner particle developed mass/area of approximately 0.4 milligrams/centimeter$^2$. The developed test areas pass beneath a collimated infrared densitometer, indicated generally by the reference numeral 64.

Infrared densitometer 64, positioned adjacent photoconductive surface 12 between developer station C and transfer station D, generates electrical signals proportional to the developed toner mass of the test areas. These signals are conveyed to the controller of the present invention for suitable processing thereat. The controller, in turn, regulates high voltage power supply 32 and motor 62 so as to control charging of photoconductive surface 12 and dispensing of toner particles into the developer mixture. Infrared densitometer 64 is energized at 15 volts DC and about 50 milliamps. The surface of infrared densitometer 64 is preferably about 7 millimeters from photoconductive surface 12. Infrared densitometer 64 includes a semiconductor light emitting diode having a 940 nanometer peak output wavelength with a 60 nanometer one-half power bandwidth. The power output is approximately $45 \pm 10$ milliwatts. A photodiode receives the light rays reflected from the test areas on photoconductive surface 12 of belt 10. The photodiode converts the measured light ray input to an electrical output signal ranging from about 0 volts to about 10 volts. Infrared densitometer 64 is also used periodically to measure the light rays reflected from the bare photoconductive surface, i.e. without developed toner particles, to provide a reference level for calculation of the signal ratios. An air purge system is associated with the infrared densitometer to prevent the accumulation of particles on the optics thereof. After the developed electrostatic latent image and developed test areas have passed beneath infrared densitometer 64, belt 10 advances the toner powder image to transfer station D.

A sheet of support material 66 is moved into contact with the toner powder image at transfer station D. The sheet of support material is advanced to transfer station D by sheet feeding apparatus 68. Preferably, sheet feeding apparatus 68 includes a feed roll 70 contacting the uppermost sheet of stack 72. Feed rolls 70 rotate so as to advance the uppermost sheet from stack 72 into chute 74. Chute 74 directs the advancing sheet of support material into contact with photoconductive surface 12 of belt 10 in a timed sequence so that the toner powder image developed thereon contacts the advancing sheet of support material at transfer station D.

Transfer station D includes a corona generating device 76 which sprays ions onto the backside of sheet 66. This attracts the toner powder image from photoconductive surface 12 to sheet 66. After transfer, the sheet continues to move, in the direction of arrow 78, onto a conveyor (not shown) which advances the sheet to fusing station E.

Fusing station E includes a fuser assembly, indicated generally by the reference numeral 80, which permanently affixes the transferred powder image to sheet 66. Preferably, fuser assembly 80 comprises a heated fuser roller 82 and a back-up roller 84. Sheet 66 passes between fuser roller 82 and back-up roller 84 will the toner powder image contacting fuser roller 82. In this manner, the toner powder image is permanently affixed to sheet 66. After fusing, chute 86 guides the advancing sheet 66 to catch tray 88 for subsequent removal from the printing machine by the operator.

After the sheet of support material is separated from photoconductive surface 12 of belt 10, the residual toner particles and the toner particles of the developed test areas adhering to photoconductive surface 12 are removed therefrom. These particles are removed from photoconductive surface 12 at cleaning station F. Cleaning station F includes a rotatably mounted fiberous brush 90 in contact with photoconductive surface 12. The particles are cleaned from photoconductive surface 12 by the rotation of brush 90 in contact therewith. Subsequent to cleaning, a discharge lamp (not shown) floods photoconductive surface 12 with light to dissipate any residual electrostatic charge remaining thereon prior to the charging thereof for the successive imaging cycle.

It is believed that the foregoing description is sufficient for purposes of the present application to illustrate the general operation of an electrophotographic printing machine incorporating the features of the present invention therein.

Referring now to FIG. 2, the details of the control system are shown thereat. As illustrated in FIG. 2, infrared densitometer 64 detects the density of the developed test areas and produces electrical output signals indicative thereof. Thus, infrared densitometer 64 generates an electrical output signal proportional to the toner mass deposited on the test area formed from light rays having an intensity of 2.5 ergs/centimeter$^2$, and another electrical output signal proportional to the toner mass deposited on the test area formed from light rays having an intensity of 1.7 ergs/centimeter$^2$. In addition, an electrical output signal is periodically generated by infrared densitometer 64 corresponding to the bare photoconductive surface. These signals are conveyed to controller 92 through suitable conversion circuitry 94. Controller 92 forms the ratio of test mass area signal/bare photoconductive surface signal and generates electrical error signals proportional thereto. In response to one of these ratio signals, controller 92 activates high voltage power supply 32 through logic interface 94. High voltage power supply 32 is electrically connected to shield 30 of corona generating device 26. The purpose of the charge control loop is to maintain a substantially constant charge level on photoconductive surface 12. For example, the standard operating condition can be assumed to about −750 volts. Under these conditions, the test area illuminated at 2.5 ergs/centimeter$^2$ has a nominal developed density of 0.1 milligrams/centimeter$^2$. Variations in the density of the developed test area are detected by infrared densitometer 64 which, in turn, produces an electrical output signal corresponding to the measured density. This electrical output signal is processed by conversion circuitry 94 and conveyed to controller 92 which generates an error signal to regulate high voltage power supply 32 through logic interface 94. Adjustments to high voltage power supply 32 regulate the potential applied to shield 30 so as to control the charge applied to photoconductive surface 12, and to maintain the dark development potential at about −750 volts.

In the toner dispensing control loop, the signal generated by infrared densitometer 64 is proportional to the developed mass/area of the test area illuminated at an intensity of about 1.7 ergs/centimeter$^2$. This developed test area has a nominal density of 0.4 milligrams/centimeter$^2$. The signal is conveyed to controller 92 through conversion circuitry 94. In response, controller 92 activates motor 62 through logic interface 98. Energization of motor 62 causes toner dispenser 50 to discharge toner particles into developer housing 52. This increases the concentration of toner particles in the developer mixture so as to increase successive developed test area to a density of at least 0.4 milligrams/centimeter$^2$. If a plurality of successive calls for additional toner particles have been made by the control loop and the density of the test area illuminated at an intensity of 1.7 ergs/centimeter$^2$ still has a density of less than 0.4 milligrams/centimeter$^2$, the controller will generate "a toner container empty" signal. This will result in an operator display being energized to indicate that the toner container no longer has toner particles therein. At this point, the operator places an additional supply of toner particles in the printing machine.

During operation of the electrophotographic printing machine, both toner particle concentration and charging current are simultaneously controlled to regulate the density of the developed test areas. Any variability in one of the control loops tends to be compensated by the other control loop. For example, high toner particle concentration will cause the controller to reduce dark development potential to return the image to the preferred level. This correlation between control loops permits larger variations from the nominal conditions, and enables faster return to nominal, than would occur with each control loop acting independently.

In recapitulation, the apparatus of the present invention controls the charging of the photoconductive surface and the concentration of toner particles within the developer mixture by detecting two different density test areas generated in the inter-image area of the photoconductive surface. A nominally lower density test area controls charging, while a nominally higher density test area controls toner particle concentration within the developer mixture. Successive calls for additional toner particles which are not complied with, indicate an out of toner condition in the toner container. This results in a display being actuated requiring the machine operator to replenish the toner supply.

It is, therefore, apparent that there has been provided, in accordance with the present invention, an apparatus for controlling the charging and toner particle concentration within the developer mixture of an electrophotographic printing machine. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for controlling the concentration of toner particles within a developer mixture of carrier granules and toner particles and regulating the charging of a photoconductive surface, including:

means for forming a first test area and a second test area on the photoconductive surface, said first test area and said second test area having toner particles deposited thereon with said first test area having a greater density of toner particles deposited thereon than said second test area; and means, responsive to the density of toner particles deposited on the first test area, for controlling the concentration of toner particles in the developer mixture, said controlling means being resposive to the density of toner particles deposited on the second test area to regulate the charge level of the photoconductive surface, said controlling means comprising an infrared densitometer positioned adjacent the photoconductive surface, means, in communication with said infrared densitometer, for generating a toner dispense signal and a charging signal, said generating means produces an empty toner container signal in response to said generating means producing a plurality of successive toner dispense signals, and means, responsive to the charging signal, for charging the photoconductive surface.

2. An apparatus according to claim 1, wherein said controlling means includes means, responsive to the toner dispense signal, for discharging toner particles into the developer material to adjust the concentration thereof.

3. An electrophotographic printing machine of the type comprising a development system having a developer mixture of carrier granules and toner particles wherein toner particles are deposited on an electrostatic latent image recorded on a photoconductive surface, and a corona generating device for charging the photoconductive surface, wherein the improvement includes:

means for forming a first test area and a second test area on the photoconductive surface, said first test area and said second test area having toner particles deposited thereon with said first test area having a greater density of toner particles deposited thereon than said second test area; and means, responsive to the density of toner particles deposited on the first test area, for controlling the concentration of toner particles in the developer mixture, said controlling means being responsive to the density of toner particles deposited on the second test area to regulate the charge level of the photoconductive surface, said controlling means comprising an infrared densitometer positioned adjacent the photoconductive surface, means, in communication with said infrared densitometer, for generating a toner dispense signal and a charging signal, said generating means produces an empty toner container signal in response to said generating means producing a plurality of successive toner dispense signals, and means, responsive to the charging signal, for regulating the corona generating device charging the photoconductive surface.

4. A printing machine according to claim 3, wherein said controlling means includes means, responsive to the toner dispense signal, for discharging toner particles into the developer mixture to adjust the concentration thereof.

* * * * *